US007956290B2

(12) United States Patent
Wang

(10) Patent No.: US 7,956,290 B2
(45) Date of Patent: Jun. 7, 2011

(54) HIGH-FREQUENCY DIGITAL A/V CABLE

(75) Inventor: Chang-Pin Wang, Hsinchuang (TW)

(73) Assignee: Sure-Fire Electrical Corporation, Hsinchuang, Taipei Hsien (TW)

( * ) Notice: Subject to any disclaimer, the term of this patent is extended or adjusted under 35 U.S.C. 154(b) by 0 days.

(21) Appl. No.: 12/408,666

(22) Filed: Mar. 20, 2009

(65) Prior Publication Data

US 2010/0236814 A1 Sep. 23, 2010

(51) Int. Cl.
*H01B 7/08* (2006.01)

(52) U.S. Cl. ..... 174/117 F

(58) Field of Classification Search ..... 174/117 F, 174/117 FF

See application file for complete search history.

(56) References Cited

U.S. PATENT DOCUMENTS 5,008,489 A * 4/1991 Weeks et al. ..... 174/36
6,630,624 B2 * 10/2003 Tsao et al. ..... 174/36
2008/0041610 A1 * 2/2008 Cheng ..... 174/117 F

* cited by examiner

*Primary Examiner* — Chau N Nguyen
(74) *Attorney, Agent, or Firm* — Muncy, Geissler, Olds & Lowe, PLLC

(57) ABSTRACT

In high-frequency digital A/V cable having high-frequency signal line sets and low-frequency signal lines arranged in a parallel array, a metal shielding layer is set within an isolation layer inside the outer plastic sheath to surround the two high-frequency signal lines of each high-frequency signal line set for EMI protection, and a metal ground wire is arranged within the outer plastic sheath at one lateral side of the parallel array of the high-frequency signal line sets and low-frequency signal lines in a parallel manner.

9 Claims, 7 Drawing Sheets

HIGH-FREQUENCY DIGITAL A/V CABLE

BACKGROUND OF THE INVENTION

1. Field of the Invention

The present invention relates to flat cables for high-frequency signal transmission applications and more particularly, to a high-frequency digital A/V cable, which provides enhanced EMI protection.

2. Description of the Related Art

In recent years, audio and video application designs have been well developed. Nowadays, many audio and video products, such as VCD, DVD, digital versatile disc, high-definition digital TV, videophone, video conference system and the like are now intensively used in our daily life. When compared to conventional techniques, these new system architectures utilize digital technology to process voice and image data. Subject to different requirements for application in different fields, different standards are established, modified and updated to improve digital signal transmission (without compression) in speed and quality so that people can enjoy better quality audio and video quality. HDMI, DVI and DisplayPort are digital video interface standards designed to maximize the visual quality of digital display devices. A DisplayPort, DVI or HDMI connector is connectable to an adapter, set-top box, DVD player, PC, TV game machine, synthesized amplifier or digital audio equipment for long distance application to transmit audio video signals stably at a high speed, satisfying consumers' requirements.

A DisplayPort, DVI or HDMI connector can be used with a round or flat cable. A cable for this purpose comprises a plurality of high-frequency signal lines and a plurality of low-frequency signal lines. During signal transmission, transmission interference may occur between the high-frequency signal lines and the low-frequency signal lines, resulting in transmission instability and interference with surrounding electronic devices. In actual practice, the conventional high-frequency digital cables have the following drawbacks:

1. The internal grounding wire can simply transfer noises from the signals to the earth, they cannot eliminate electromagnetic interference.

2. The insulation layers that surround the metal core wires of the high-frequency signal lines and low-frequency signal lines cannot protect the respective metal core wires against interference of external noises.

Therefore, it is desirable to provide a high-frequency digital A/V cable that eliminates the aforesaid drawbacks.

SUMMARY OF THE INVENTION

The present invention has been accomplished under the circumstances in view. It is the main object of the present invention to provide a high-frequency digital A/V cable, which provides enhanced EMI protection.

To achieve this and other objects of the present invention, the high-frequency digital A/V cable comprises a plurality of high-frequency signal line sets and a plurality of low-frequency signal lines arranged in a parallel array, an isolation layer surrounding the high-frequency signal line sets and the low-frequency signal lines, and an outer plastic sheath surrounding the isolation layer. Each high-frequency signal line set comprises a high-frequency grounding line, a first high-frequency signal line and a second high-frequency signal line. Further, a metal ground wire is arranged within the outer plastic sheath at one lateral side of the parallel array of the high-frequency signal line sets and low-frequency signal lines in a parallel manner. Further, metal shielding layers are set within the isolation layer to surround the first high-frequency signal line and second high-frequency signal line of each of the high-frequency signal line sets, providing enhanced EMI protection.

DETAILED DESCRIPTION OF THE PREFERRED EMBODIMENT

Figure 1:
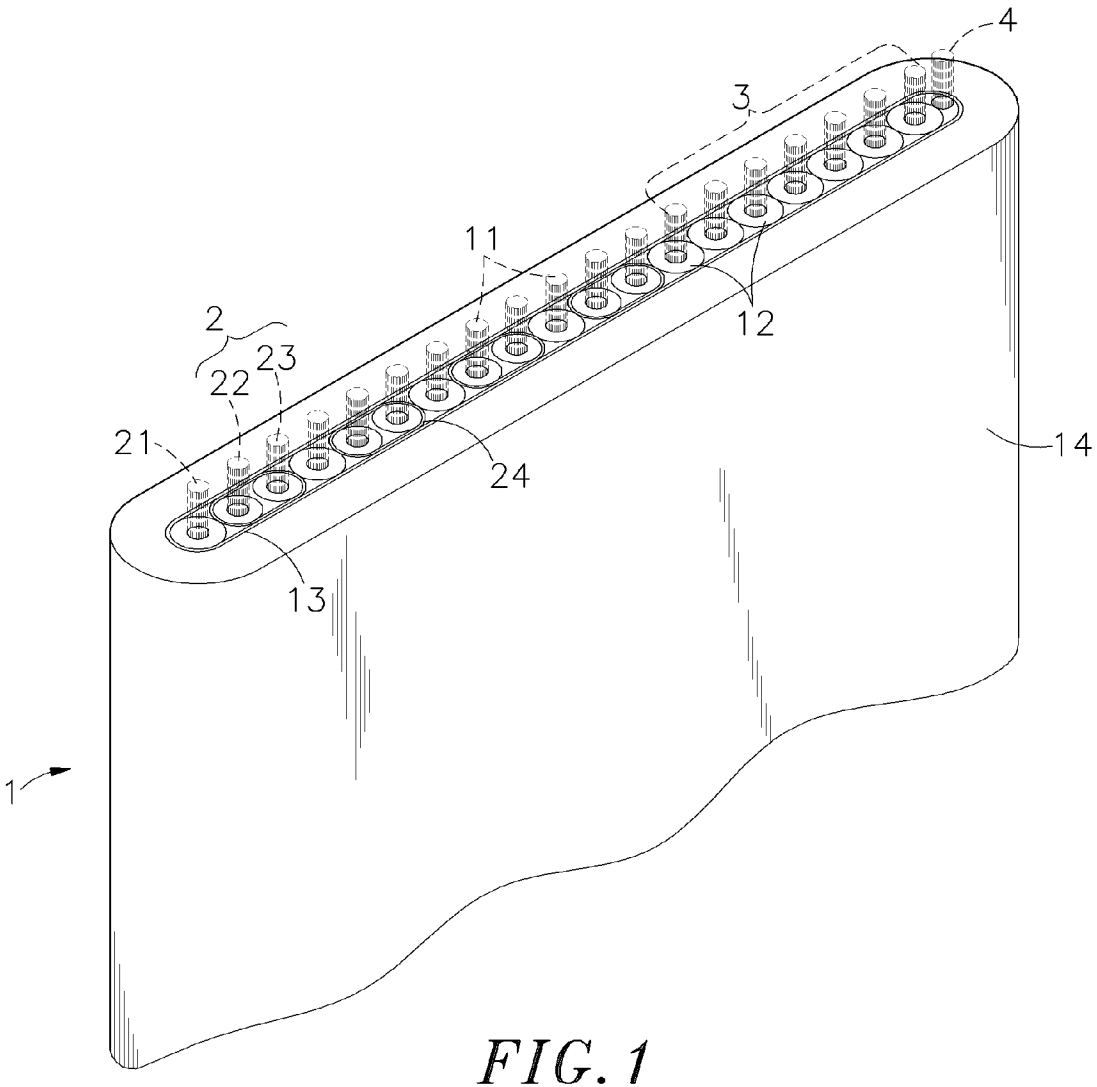
FIG. 1 is a perspective view of a high-frequency digital A/V cable in accordance with the present invention.
Figure 2:
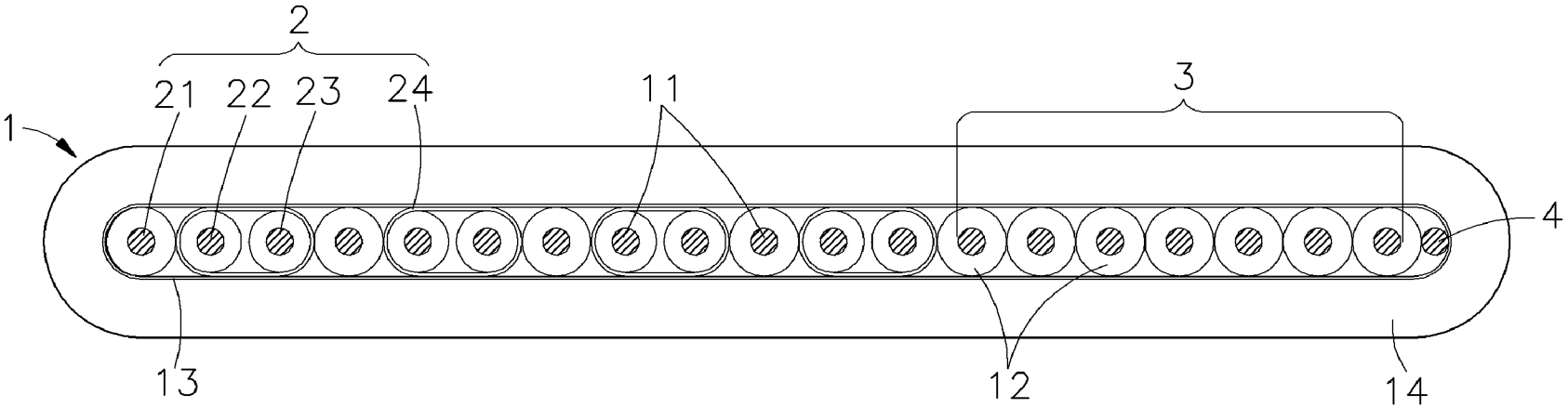
FIG. 2 is an end view of the high-frequency digital A/V cable shown in FIG. 1.

Referring to FIGS. 1 and 2, a high-frequency digital A/V cable 1 in accordance with the present invention is shown comprising a plurality of metal core wires 11 arranged in a parallel array, an isolation layer 13 surrounding the metal core wires 11, and an outer plastic sheath 14 surrounding the isolation layer 13. The high-frequency digital A/V cable 1 shows the shape of a flat cable. One last metal core wire 11 of the parallel array of metal core wires 11 is designated as a ground wire 4. The high-frequency digital A/V cable 1 further comprises a plurality of insulation layers 12 respectively surrounding the other metal core wires 11 within the isolation layer 13. The metal core wires 11 that are respectively covered with a respective insulation layer 12 are defined to form a plurality of high-frequency signal line sets 2 and a plurality of low-frequency signal lines 3. The low-frequency signal lines 3 are arranged in parallel between the high-frequency signal line sets 2 and the ground wire 4. Each high-frequency signal line set 2 includes a high-frequency grounding line 21, a first high-frequency signal line 22 and a second high-frequency signal line 23. The high-frequency digital A/V cable 1 further comprises a plurality of metal shielding layers 24 respectively surrounding the first high-frequency signal line 22 and second high-frequency signal line 23 of each high-frequency signal line set 2 within the isolation layer 13. Further, the insulation layers 12 of the metal core wires 11 of the high-frequency grounding line 21, first high-frequency signal line 22 and second high-frequency signal line 23 of each high-frequency signal line set 2 are made in black color, white color and red color respectively. Further, the insulation layers 12 of the metal core wires 11 of the low-frequency signal lines 3 are made in red color.

After fabrication, the high-frequency digital A/V cable 1 must pass through an EMI (Electromagnetic interference) test before use. When tested, conventional cables commonly show a frequency above the level of 40 dBuV/m. Under the same test conditions, the high-frequency digital A/V cable 1 shows a frequency below the level of 40 dBuV/m. Therefore, the high-frequency digital A/V cable 1 avoids electromagnetic interference and improves high-frequency digital A/V signal transmission stability.

Figure 3:
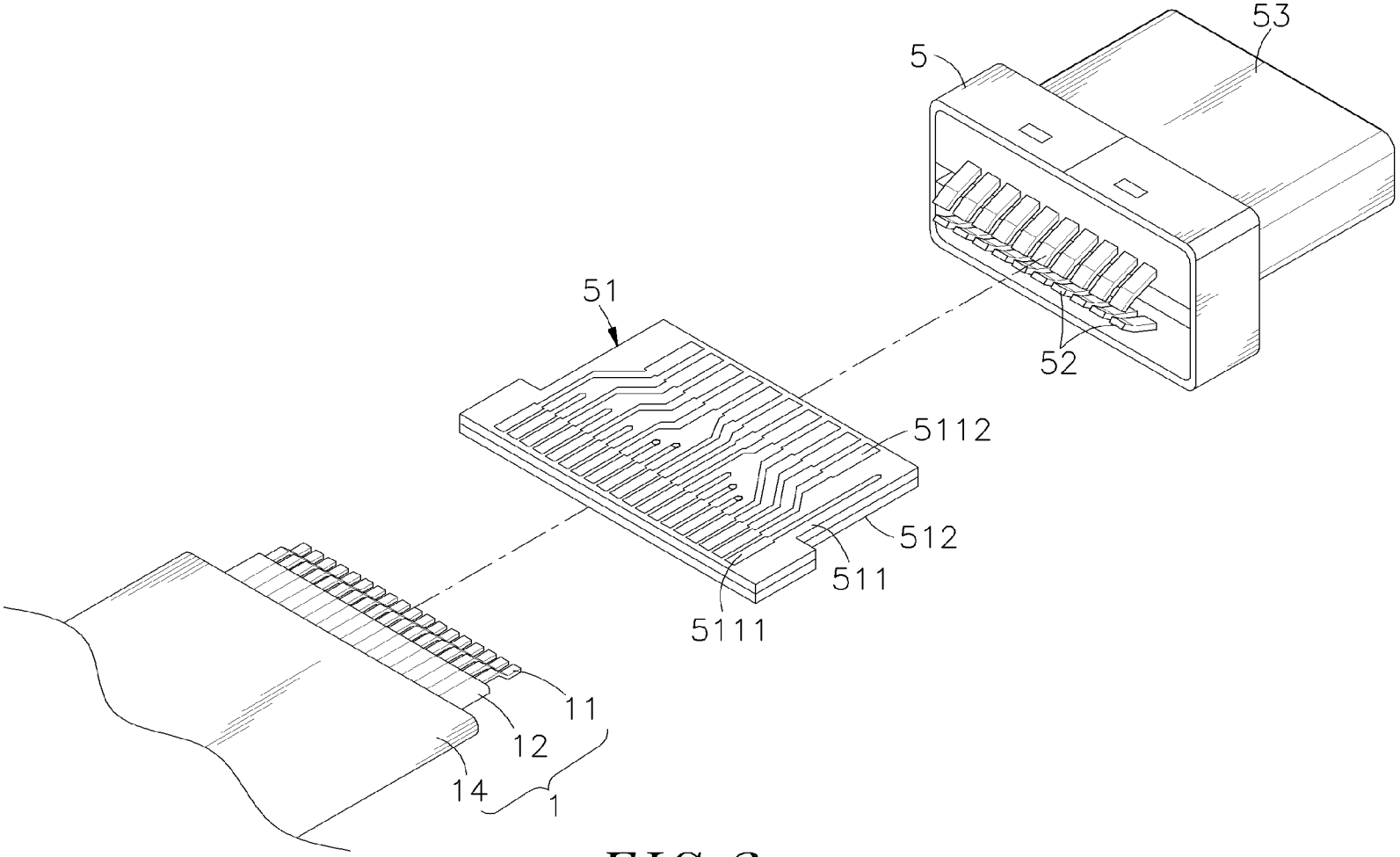
FIG. 3 is an exploded view of a high-frequency cable connector for use with the high-frequency digital A/V cable in accordance with the present invention.
Figure 4:
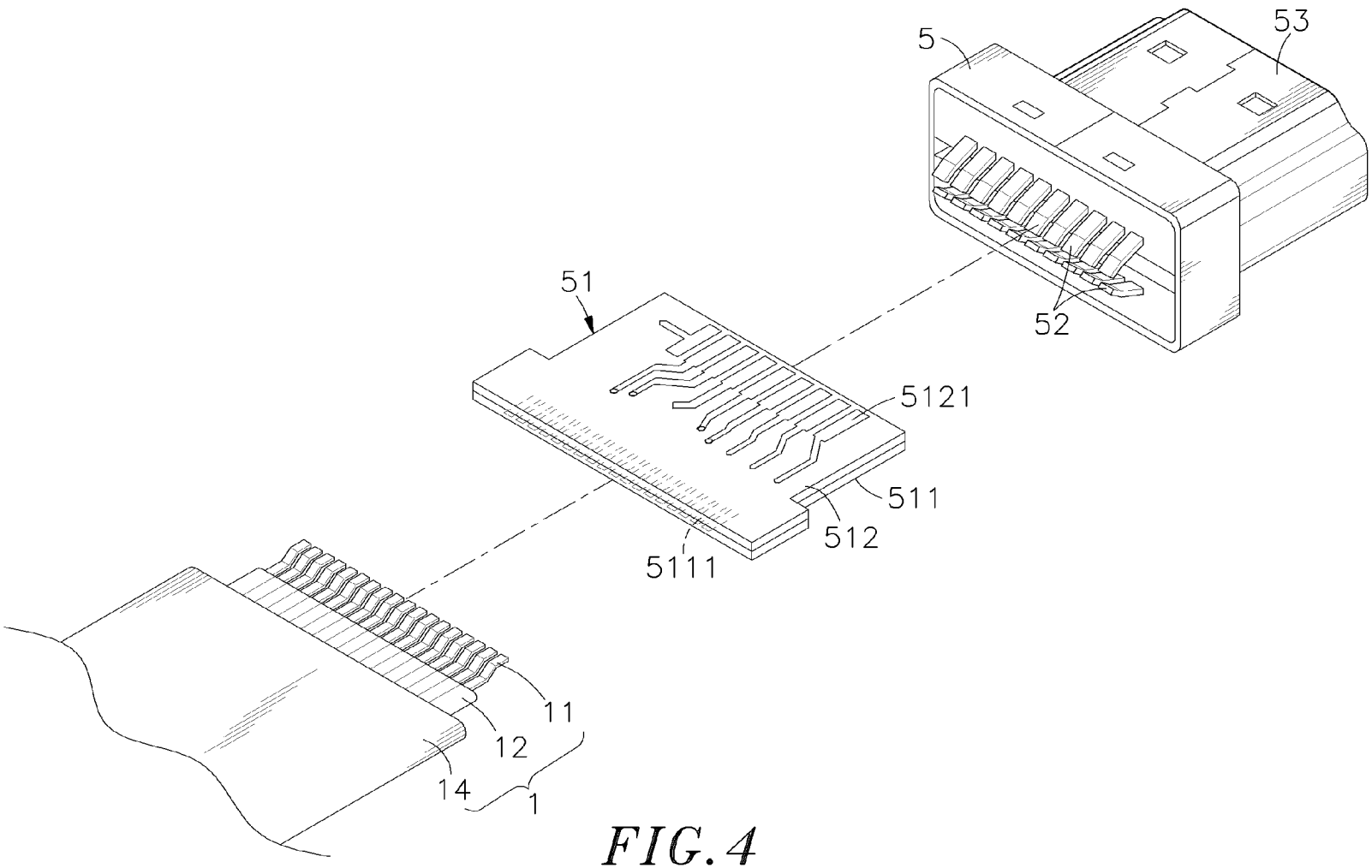
FIG. 4 corresponds to FIG. 3 when viewed from the bottom side.
Figure 5:
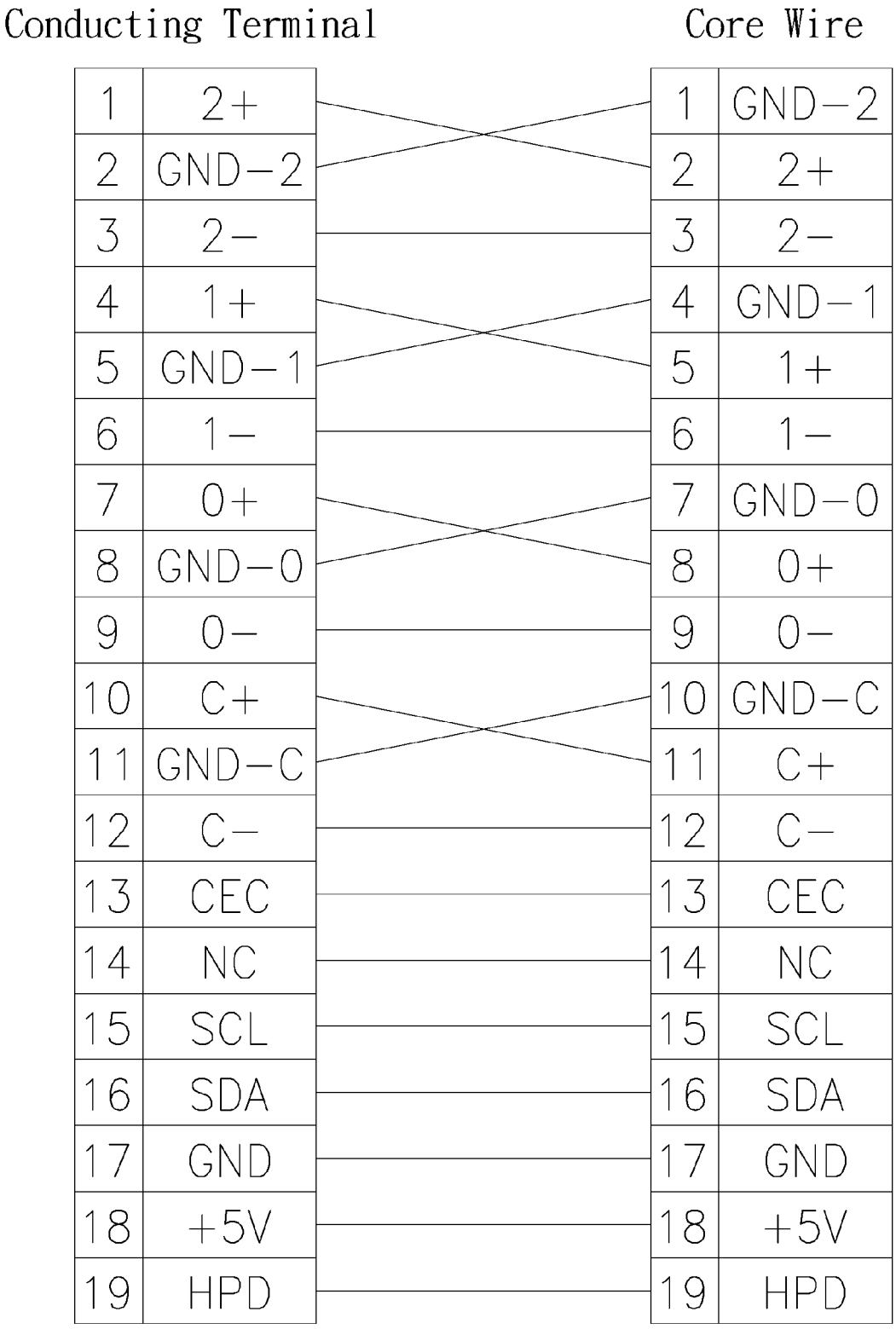
FIG. 5 is a pin configuration diagram according to the present invention.

Referring to FIGS. 3-5 and FIG. 2 again, the number of the metal core wires 11 of the high-frequency digital A/V cable 1 can be 19. These metal core wires 11 are arranged on the same plane in an order from 1 through 19 to be: GND-2, 2+, 2−, GND-1, 1+, 1−, GND-0, 0+, 0−, GND-C, C+, C−, CEC, NC, SCL, SDA, GND, +5V and HPD respectively for bonding to rear metal contacts 5111 on a first surface 511 of an adapter circuit board 51 of a high-frequency cable connector 5. The high-frequency cable connector 5 can be a HDMI (high-definition multimedia interface) connector having adapter terminals 52 numbered from 1 through 19 to be: 2+, GND-2, 2−, 1+, GND-1, 1−, 0+, GND-0, 0−, C+, GND-C, C−, CEC, NC, SCL, SDA, GND, +5V and HPD respectively for bonding to first metal contacts 5112 on the first surface 511 and second metal contacts 5121 on the second surface 512 of the adapter circuit board 51.

Further, the number of the metal core wires 11 of the high-frequency digital A/V cable 1 can be 20 for use with a DisplayPort cable connector, or at least 24 for use with a DVI cable connector.

The aforesaid metal core wires 11 can be formed of flexible aluminum, iron or copper. The metal shielding layer 24 that surrounds the first high-frequency signal line 22 and second high-frequency signal line 23 of each high-frequency signal line set 2 can be a tin foil, copper tape wrapped shield, or copper wire woven shield. Further, the high-frequency grounding line 21 of each high-frequency signal line set 2 and the ground wire 4 can be a tinned copper wire, copper wire, or silvered metal wire.

Figure 6:
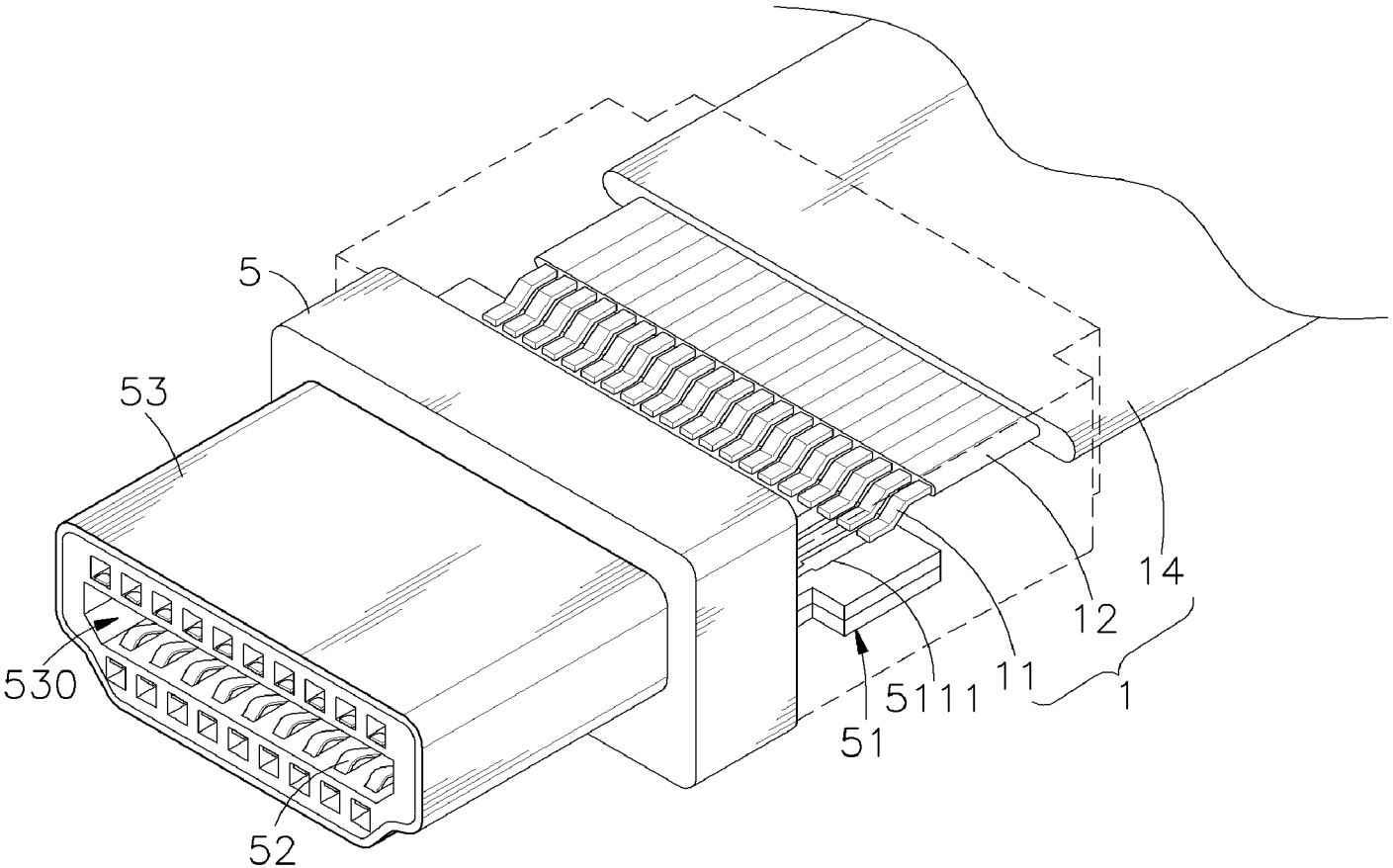
FIG. 6 is a perspective view showing one application example of the present invention.
Figure 7:
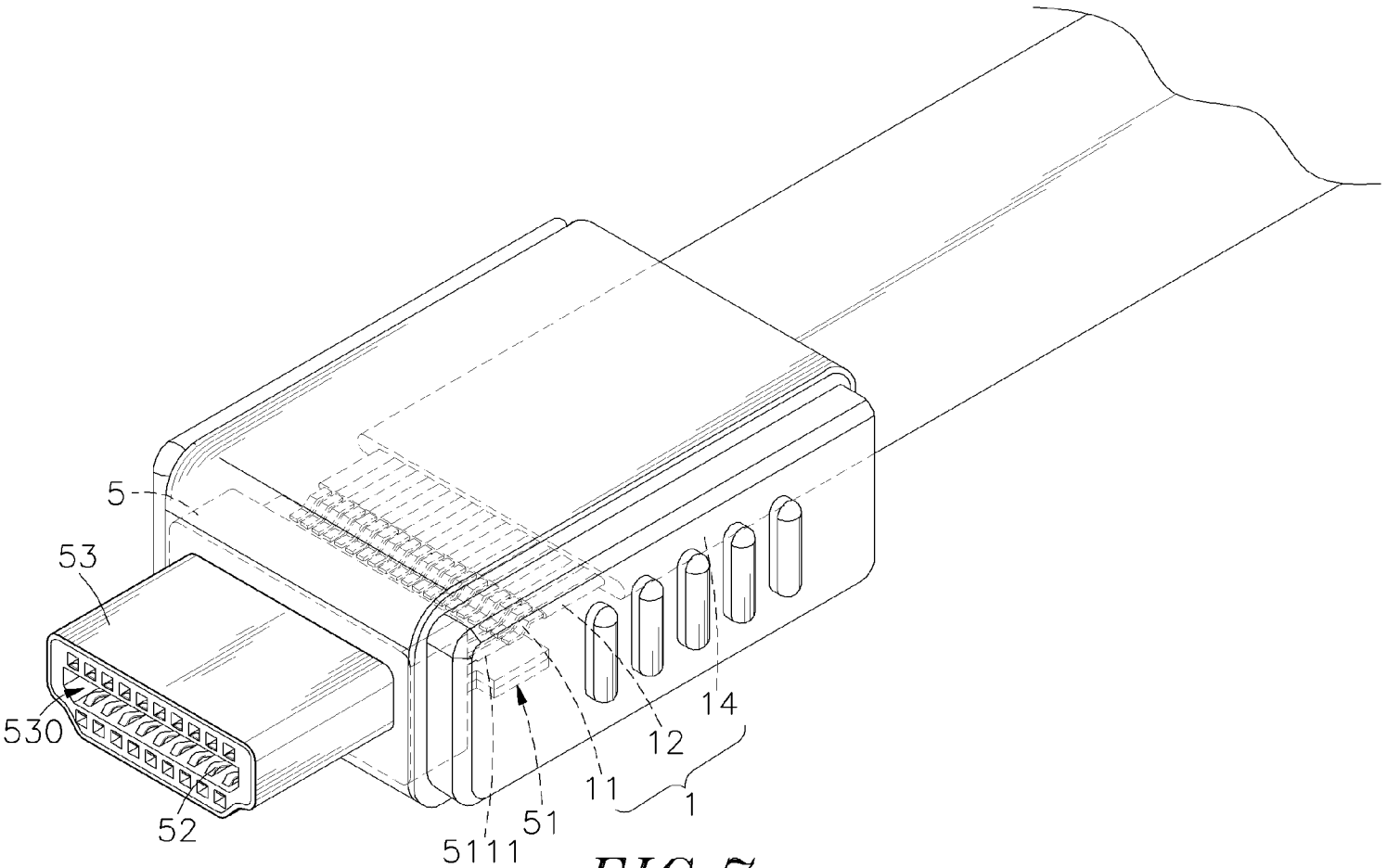
FIG. 7 is a perspective view showing another application example of the present invention.

Referring to FIGS. 6 and 7 and FIGS. 2, 3 and 4 again, the metal core wires 11 of the high-frequency digital A/V cable 1 are respectively bonded to the rear metal contacts 5111 on the first surface 511 of the adapter circuit board 51 of the high-frequency cable connector 5. The adapter terminals 52 of the high-frequency cable connector 5 have the respective rear ends respectively bonded to the first metal contacts 5112 and second metal contacts 5121 on the first surface 511 and second surface 512 of the adapter circuit board 51, and the respective rear ends extended to a front insertion slot 530 in a front extension connection portion 53 of the high-frequency cable connector 5 for the contact of metal terminals of an external matching connector (not shown) for the transmission of high-frequency digital D/V signals. The high-frequency cable connector 5 can be a HDMI connector, DisplayPort connector or DVI connector, configured to match the high-frequency digital A/V cable 1.

The above description is simply an exemplar of the present invention but not a limitation. The high-frequency digital A/V cable 1 has set therein a parallel array of metal core wires 11 that define multiple high-frequency signal line sets 2 and a set of low-frequency signal lines 3. Each high-frequency signal line sets 2 is formed of three metal core wires 11 designated to be a high-frequency grounding line 21, a first high-frequency signal line and a second high-frequency signal line 23. The first high-frequency signal line 22 and the second high-frequency signal line 23 are surrounded by a metal shielding layer 24 for EMI protection. Therefore, the multiple high-frequency signal line sets 2 can transmit high-frequency A/V signals stably.

In conclusion, the invention provides a high-frequency digital A/V cable 1, which has the following advantages and features:

1. The high-frequency digital A/V cable 1 has a grounding conductor 4 arranged at one lateral side of the metal core wires 11 thereof in a parallel manner, and the first high-frequency signal line 22 and second high-frequency signal line 23 of each high-frequency signal line set 2, which is formed of three adjacent metal core wires 11, are surrounded by a metal shielding layer 24 for EMI protection to assure stable transmission of high-frequency digital A/V signals.

2. The multiple high-frequency signal line sets 2 and the set of low-frequency signal lines 3 are arranged in a parallel array, and the first high-frequency signal line 22 and second high-frequency signal line 23 of each high-frequency signal line set 2 are surrounded by a metal shielding layer 24, and therefore the high-frequency digital A/V cable 1 eliminates interference between the multiple high-frequency signal line sets 2 and the set of low-frequency signal lines 3.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A high-frequency digital A/V cable comprising a plurality of high-frequency signal line sets and a plurality of low-frequency signal lines arranged in a parallel array, each of said high-frequency signal line sets comprising a high-frequency grounding line, a first high-frequency signal line and a second high-frequency signal line, the high-frequency grounding lines, first high-frequency signal lines and second high-frequency signal lines of said high-frequency signal line sets and said low-frequency signal lines each comprising a metal core wire and an insulation layer surrounding the metal core wire;

an isolation layer surrounding said high-frequency signal line sets and said low-frequency signal lines; and an outer plastic sheath surrounding said isolation layer;

wherein the high-frequency digital A/V cable further comprises a plurality of metal shielding layers set within said isolation layer and respectively surrounding the first high-frequency signal line and second high-frequency signal line of each of said high-frequency signal line sets, and a metal ground wire arranged within said outer plastic sheath at one lateral side of the parallel array of said high-frequency signal line sets and said low-frequency signal lines in a parallel manner.

2. The high-frequency digital A/V cable as claimed in claim 1, which is configured to match a 19-pin HDMI connector.

3. The high-frequency digital A/V cable as claimed in claim 1, which is configured to match a 20-pin DisplayPort male connector.

4. The high-frequency digital A/V cable as claimed in claim 1, which is configured to match a 24-pin DVI male connector.

5. The high-frequency digital A/V cable as claimed in claim 1, wherein the metal core wires of the high-frequency grounding lines, first high-frequency signal lines and second high-frequency signal lines of said high-frequency signal line sets and said low-frequency signal line are selected from a material group of flexible aluminum, iron and copper.

6. The high-frequency digital A/V cable as claimed in claim 1, wherein said metal shielding layers are selected from a material group of tin foil, copper tape wrapped shield and copper wire woven shield.

7. The high-frequency digital A/V cable as claimed in claim 1, wherein said metal ground wire is selected from a material group of tinned copper wire, copper wire and silvered metal wire.

8. The high-frequency digital A/V cable as claimed in claim 1, wherein the insulation layers of the high-frequency grounding line, first high-frequency signal line and second high-frequency signal line of each said high-frequency signal line set are made in black color, white color and red color respectively.

9. The high-frequency digital A/V cable as claimed in claim 1, wherein the insulation layers of said low-frequency signal lines are made in red color.

* * * * *